US005890367A

United States Patent [19]

You et al.

[11] Patent Number: 5,890,367

[45] Date of Patent: Apr. 6, 1999

[54] AIR CONDITIONING SYSTEM FOR SEMICONDUCTOR CLEAN ROOM INCLUDING A CHEMICAL FILTER DOWNSTREAM OF A HUMIDIFIER

[75] Inventors: Nam-hee You, Songnam; Jung-sung Hwang; Gee-do Kim, both of Suwon; Young-jin Han, Suyoung-gu, all of Rep. of Korea

[73] Assignee: Samsung Electronics Co., Ltd., Suwon, Rep. of Korea

[21] Appl. No.: 899,388

[22] Filed: Jul. 23, 1997

[30] Foreign Application Priority Data

Jul. 24, 1996 [KR] Rep. of Korea ..... 96-29967

[51] Int. Cl.[6] ..... F24F 3/16; F25D 17/06; B01L 1/04

[52] U.S. Cl. ..... 62/78; 62/92; 454/187

[58] Field of Search ..... 62/78, 91, 92, 62/93; 454/187; 95/285; 96/135; 55/485, 524

[56] References Cited

U.S. PATENT DOCUMENTS

| | | | |
|---|---|---|---|
| 5,326,316 | 7/1994 | Hashimoto et al. | 454/187 |
| 5,434,644 | 7/1995 | Kitano et al. | 355/30 |
| 5,607,647 | 3/1997 | Kinkead | 422/122 |
| 5,626,820 | 5/1997 | Kinkead et al. | 422/122 |

*Primary Examiner*—William Doerrler

*Attorney, Agent, or Firm*—Jones & Volentine, L.L.P.

[57] ABSTRACT

An air conditioning system for a semiconductor clean room includes a chemical filter between an air conditioner including a humidifier and a ULPA filter of the clean room, for ionizing chemical impurities using moisture supplied from the humidifier and then adsorbing the ionized chemical impurities by using the chemical filter. The chemical filter is installed downstream of the humidifier, which applies phosphoric acid for the prevention of scale-formation. This downstream location allows the chemical filter to prevent the phosphoric acid from being included in the fresh air as a new chemical impurity, which makes regulation of temperature and humidity of the air possible without having to use a special and expensive pure steam system.

3 Claims, 2 Drawing Sheets

AIR CONDITIONING SYSTEM FOR SEMICONDUCTOR CLEAN ROOM INCLUDING A CHEMICAL FILTER DOWNSTREAM OF A HUMIDIFIER

BACKGROUND OF THE INVENTION

1. Field of the Invention

The present invention relates to an air conditioning system for a semiconductor clean room for supplying cleaned fresh air to the clean room, and more particularly, to an air conditioning system for a semiconductor clean room which removes chemical impurities by locating a chemical filter between the humidifier of an air conditioner and the clean room.

2. Background of the Related Art

A clean room is a special dust-free space where dust (floating particles) in the air is reduced to some desired cleanliness level so as to protect workpieces from being contaminated with dust. In a clean room, air-conditioning and light intensity are also regulated and noise and shock are minimized.

A fabrication line for a semiconductor device includes basic design processes such as pattern generation or reticle fabrication, a fabrication process for a wafer, an inspection process, an assembly/packaging process, a final inspection process and a quality examination process. Repetitive processes of diffusion, exposure, development, etching and diffusion are performed during fabrication of the wafer, so it is very important to control dust-like contaminants and regulate temperature and humidity so as to improve yields, and to ensure precision and reliability of semiconductor products.

The atmosphere outside of the clean room may include many particles and water vapor as well as smoke, and thus it is required to clean and filter the air before it circulates into the clean room.

FIG. 1 shows a schematic view of a conventional air conditioning system for a semiconductor clean room for removing dust as well as for regulating temperature and humidity. Outdoor air passes a first air conditioner 1 so as to be cleaned, and the resultant fresh air passes through a fresh air duct 2 located between the air conditioner 1 and recirculating air duct 11 to be supplied into the clean room 5. Before going into the clean room, the fresh air optionally passes through a ULPA filter (Ultra Low Penetration Air Filter) 4 according to the cleanliness required for the particular class of clean room.

For more efficient and economical operation, the fresh air, which was diverted before going into the clean room 5 or which passed by the clean room 5, passes through an additional second air conditioner 8 or a third air conditioner 9 for regulating air temperature and humidity once more before recirculating into the clean room. Furthermore, the fresh air may pass through a special dry air scrubber 7 for removing impurities in the fresh air.

To improve the efficiency of an air conditioning system for supplying fresh air into a clean room by means of the second air conditioner 8 and the third air conditioner 9, the system has been designed to circulate the fresh air centered about the clean room 5 via the following three circulating paths: (1) a first circulation line for cleaning the fresh air which passes through the first air conditioner 1 by way of the fresh air duct 2, the second air conditioner 8, the ULPA filter 4, the clean room 5 and the dry air scrubber 7; (2) a second circulation line for cleaning the fresh air which passes through the first air conditioner 1 by way of the fresh air duct 2, the second air conditioner 8, the ULPA filter 4, the clean room 5, the third air conditioner 9, the ULPA filter 4 for a second time, the clean room 5 for a second time, and the dry air scrubber 7; and (3) a third circulation line for cleaning the fresh air which passes through the first air conditioner 1 by way of the third air conditioner 9, the ULPA filter 4, the clean room 5 and the dry air scrubber 7.

In addition, a fresh air supply damper 3 (shown in dotted lines in FIG. 1) can be supplied beneath the floor of the clean room, and is accessible to the clean room via a grating 6 located under the lower part of the floor. The air supply damper 3 allows the fresh air in the clean room to alternatively recirculate or be discharged toward the outside.

In this system, as shown in FIG. 2, each of the first air conditioner 1, the second air conditioner 8 and the third air conditioner 9 generally has a dehumidifier 1*a*, a preheater 1*b*, a prefilter 1*c*, a medium filter 1*d*, a cooler 1*e*, a heater 1*f*, a humidifier 1*g*, an air blowing fan 1*h* and a HEPA filter (High Efficiency Particulate Air Filter) 1*i* in sequence from the upstream to the downstream direction of air flow, so as to let the outdoor air flow toward the clean room 5 as driven by the air blowing fan 1*h*. In this cleaning process, dust particles up to 0.1 $\mu$m in the fresh air are removed up to 99.9999% by means of the prefilter 1*c*, the medium filter 1*d* and the HEPA filter 1*i*. Also, the humidity of the air is regulated by selectively operating the dehumidifier 1*a* and the humidifier 1*g*, and the temperature of the air is controlled by selectively operating the heater 1*f* and the cooler 1*e*, so that controlled fresh air is supplied into the clean room 5.

However, this conventional air conditioning system for a semiconductor clean room is not effective for the removal of chemical molecular impurities having an outside diameter in the angstrom(Å) range, such as sulfur dioxide $SO_2$, nitrogen dioxide $NO_2$ and phosphoric acid $H_3PO_4$, which are chemically reactive with the surface material of a wafer and to which the fabrication process of a semiconductor is sensitive. Table 1 shows the concentrations of chemical impurities in the air which flows through the air conditioning system of FIG. 1 measured at points A, B, and C.

TABLE 1

The concentration distribution of phosphoric acid at each point in the air conditioning system for a semiconductor clean room (unit; $\mu g/m^3$)

| | Measuring Point A | Measuring Point B | Measuring Point C |
|---|---|---|---|
| Before Passing a Humidifier | 0.502 | 0.0051 | 0.12 |
| After Passing a Humidifier | 0.829 | 0.0068 | 0.21 |

As shown in Table 1, the concentration of phosphoric acid rapidly increased at each measuring point after the air passed a humidifier 1*g*, which results from the fact that phosphoric acid is used as an additive so as to prevent the formation of scale in the humidifier 1*g* of the first air conditioner 1, the second air conditioner 8 and the third air conditioner 9.

These chemical impurities, which tend to stick to the film surface of a wafer as hydrophilic contaminants, cause short-circuits by eating into metals, change the electrical properties of the wafer, and cause defects such as formation of water spots on the surface of the wafer and fading of a pad.

As a means for removing these chemical impurities, the pore size of a filter may be made considerably smaller so as to make physical filtering practicable. However, the reduction of the pore size makes it more difficult to fabricate the filter itself, increases the filtering pressure of the air, decreases the amount of filtered air per unit time, and increases unit production cost of the filter.

The addition of phosphoric acid to the humidifier 1*g* may be avoided so as to substantially reduce the amount of phosphoric acid introduced into the air. However, in order to safely eliminate phosphoric acid, a special pure steam system must be used.

In light of the foregoing, a need exists for an economical system for removing these chemical impurities, without having to use a special steam system.

SUMMARY OF THE INVENTION

Accordingly, the present invention is directed to an air conditioning system for a semiconductor clean room that substantially overcomes one or more of the problems due to limitations and disadvantages of the related art.

The present invention provides an air conditioning system for a semiconductor clean room in which a chemical filter for filtering chemical impurities by means of an ion-exchange method is installed between the humidifier portion of an air conditioner and a ULPA filter of a clean room, so as to ionize the chemical impurities with moisture supplied from the humidifier and then adsorb them by the chemical filter.

Up The chemical filter is installed downstream of the humidifier, which uses phosphoric acid for the prevention of scale-formation, thereby preventing the fresh air from being contaminated with the phosphoric acid.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate an embodiment of the invention, in which.

DETAILED DESCRIPTION OF PREFERRED EMBODIMENT

Reference will now be made in detail to the preferred embodiment of the present invention, an example of which is illustrated in the accompanying drawings.

Figure 1:
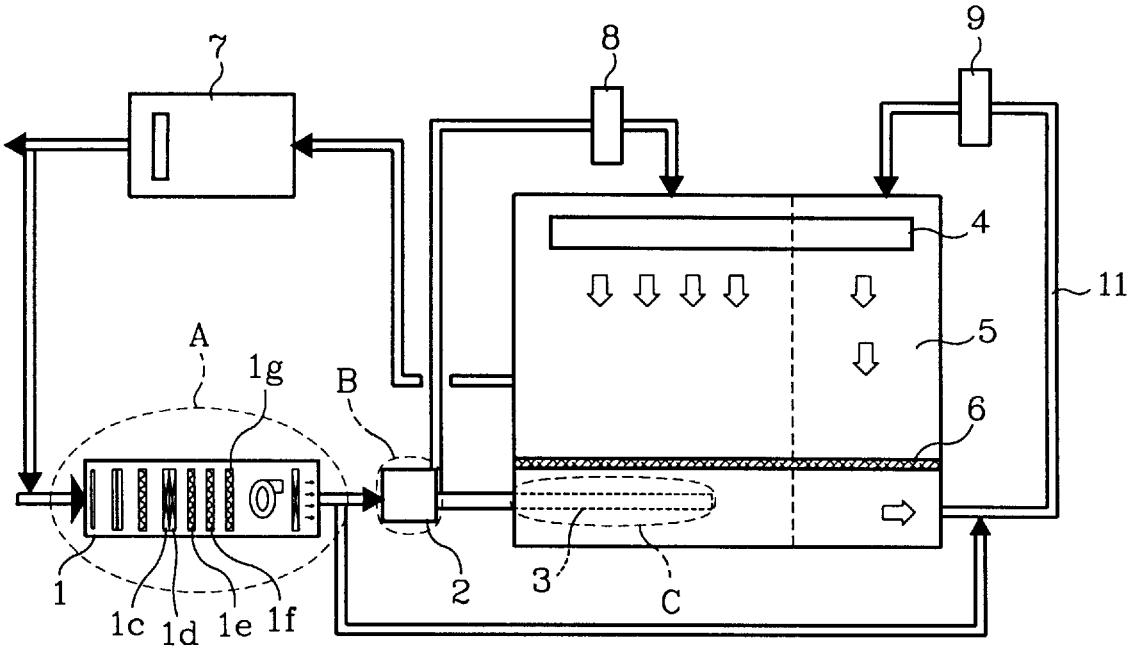
FIG. 1 (PRIOR ART)
FIG. 1 is a schematic diagram of a conventional air conditioning system for a semiconductor clean room.
Figure 2:
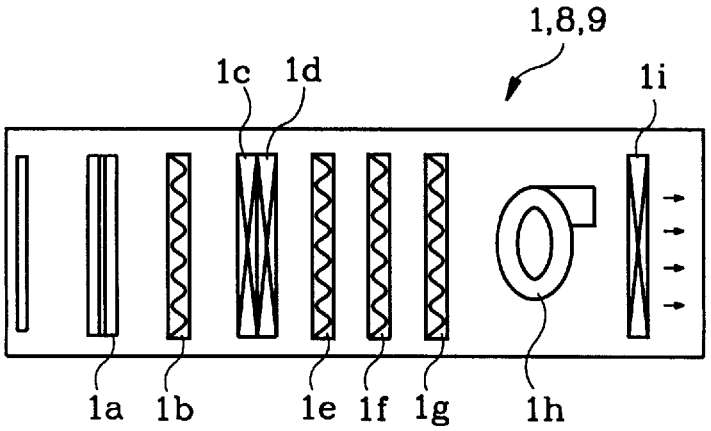
FIG. 2 (PRIOR ART)
FIG. 2 is a schematic diagram of a conventional air conditioner for the air conditioning system of FIG. 1.
Figure 3:
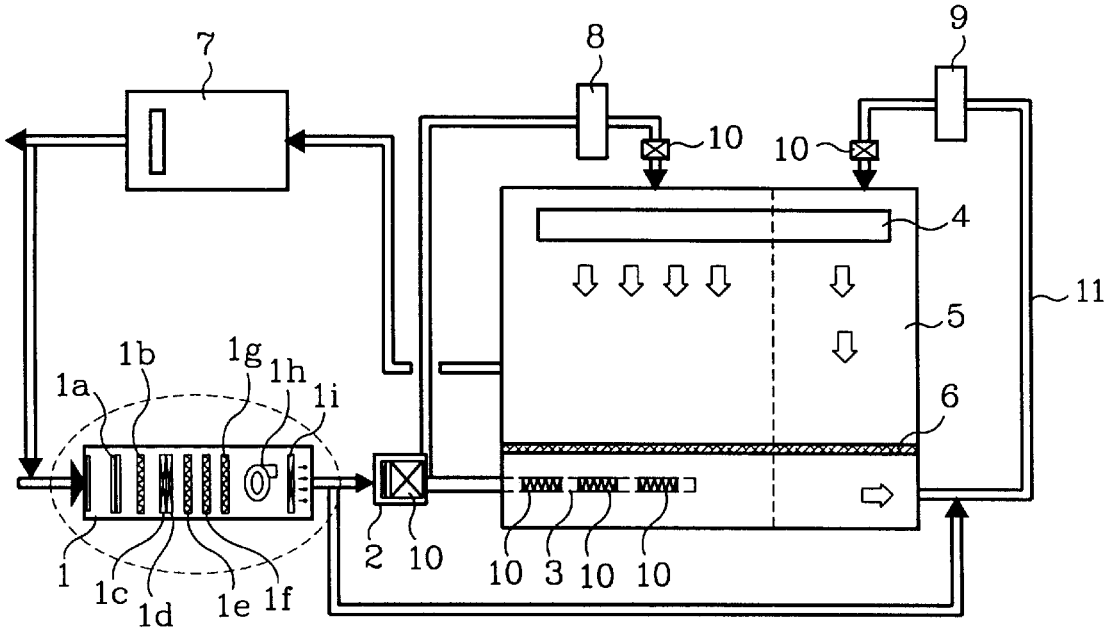
FIG. 3 is a schematic diagram of the air conditioning system for a semiconductor clean room according to an embodiment of the present invention.

As illustrated in FIG. 3, the air conditioning system according to the present invention, for supplying fresh air into a clean room 5 by means of a first air conditioner 1 including a humidifier 1*g*, is designed to circulate fresh air centered about the clean room 5 via the three circulating paths described above in reference to the conventional air conditioning system: (1) a first circulation line for cleaning the fresh air which passes through the first air conditioner 1 by way of a fresh air duct 2, a second air conditioner 8, a ULPA filter 4, a clean room 5 and a dry air scrubber 7; (2) a second circulation line for cleaning the fresh air which passes through the first air conditioner 1 by way of the fresh air duct 2, the second air conditioner 8, the ULPA filter 4, the clean room 5, a third air conditioner 9, the ULPA filter 4 a second time, the clean room 5 a second time, and the dry air scrubber 7; and (3) a third circulation line for cleaning the fresh air which passes through the first air conditioner 1 by way of the third air conditioner 9, the ULPA filter 4, the clean room 5 and the dry air scrubber 7.

The air conditioning system of the present invention further comprises a chemical filter 10 disposed in the fresh air duct 2 which is located between the air conditioner 1 and recirculating air duct 11 between the ULPA filter 4 and the first air conditioner 1, the second air conditioner 8 and the third air conditioner 9, for filtering chemical impurities by means of an ion-exchange method. The chemical filter 10 chemically removes ion impurities from the fresh air by adsorbing and coupling counter ions to be removed which stick to the filter itself.

In addition to the chemical filters 10 provided downstream of the second air conditioner 8 and the third air conditioner 9, the chemical filter 10 provided downstream of the first air conditioner 1 can be located within the fresh air duct 2 or within a damper housing of the fresh air supply damper 3 that is located under the lower part of the floor of the clean room 5. Preferably, the chemical filter 10 is provided both within the fresh air duct 2 and within the damper housing of the fresh air supply damper 3.

In the above system, each of the first air conditioner 1, the second air conditioner 8 and the third air conditioner 9 generally has a dehumidifier 1*a*, a preheater 1*b*, a prefilter 1*c*, a medium filter 1*d*, a cooler 1*e*, a heater 1*f*, a humidifier 1*g*, an air blowing fan 1*h* and a HEPA filter 1*i*, which are commercially available and are easily understood by anyone having common knowledge in the related fields.

The fresh air duct 2 is located between the clean room 5 and each of the first air conditioner 1 and the second air conditioner 8 so as to directly introduce a fresh air current into the clean room 5. Also, it is easy to install the chemical filter 10 within the fresh air duct 2.

In addition, the fresh air supply damper 3 is generally separated from the clean room 5 by a grating 6 and located under the lower part of the floor of the clean room 5 so as to let the fresh air which passes through the clean room 5 alternatively recirculate or be discharged toward the outside. The chemical filter 10 can be installed in the inner space of the damper housing of the fresh air supply damper 3.

Figure 4:
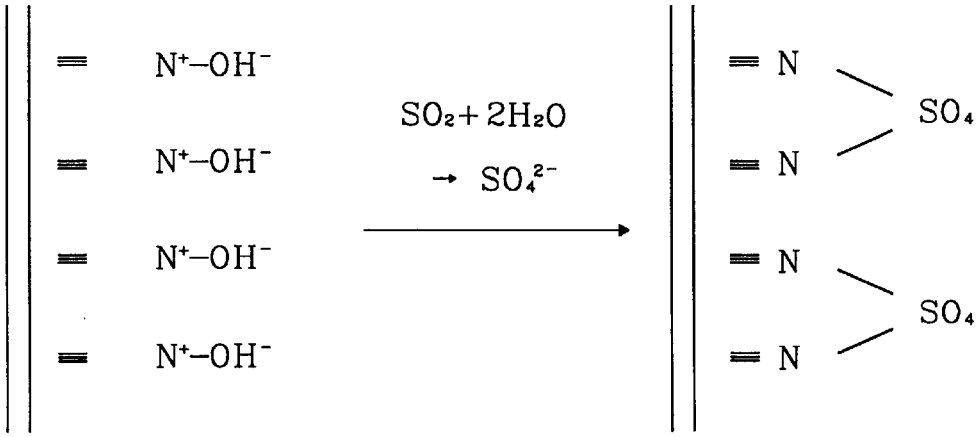
FIG. 4 is a diagram illustrating the process of adsorption of chemical impurities by means of a chemical filter applied in the present invention.

The chemical filter 10 is commercially available and easily understood by anyone having common knowledge in the related technological fields. FIG. 4 is a diagram illustrating the process by which chemical impurities are ionized by moisture supplied from the humidifier and then chemically adsorbed by the chemical filter 10.

As described above, the chemical filter 10 is located downstream of the humidifier 1*g* so as to remove dust contained in outdoor air or circulating fresh air through the first air conditioner 1, the second air conditioner 8 and the third air conditioner 9. After the regulation of temperature and/or humidity, the fresh air is supplied into the clean room 5 through the fresh air duct 2. In this process, chemical impurities in the flow of the fresh air are easily ionized by moisture supplied from the humidifier 1*g* or converted into ionizable forms and then adsorbed by the chemical filter 10 through chemical reactions. In particular, even though phosphoric acid which is used for the prevention of scale-formation in the humidifier 1*g* may act as a chemical impurity in the fresh air, the phosphoric acid can be easily removed by the chemical filter 10 which is located downstream of the humidifier 1*g*.

Accordingly, the present invention makes it possible to effectively remove chemical impurities without any special change in the conventional air conditioning system for a semiconductor clean room by using the existing filters.

The present invention, in which phosphoric acid is used to prevent scale-formation as in the prior art, thus prevents the phosphoric acid from being included in the fresh air as a new chemical impurity, which makes regulation of air temperature and humidity possible without having to use a special and expensive pure steam system.

It will be apparent to those skilled in the art that various modifications and variations can be made in the air conditioning system for a semiconductor clean room of the present invention without departing from the spirit or scope of the invention. Thus, it is intended that the present invention cover the modifications and variations of this invention provided they come within the scope of the appended claims and their equivalents.

What is claimed is:

1. An air conditioning system for a semiconductor clean room which is designed to provide fresh air to the clean room, comprising:

an ULPA (Ultra Low Penetration Air) filter installed in an upper portion of the clean room;

a recirculating air duct connecting a lower portion of the clean room and the ULPA filter for recirculating air that flows out from the clean room for reuse in the clean room;

an air conditioner including both a humidifier and a dehumidifier for regulating the humidity of the air;

a fresh air duct located between the air conditioner and the recirculating air duct; and a chemical ion-exchange filter disposed downstream of the humidifier within the fresh air duct for removing chemical molecular impurities including sulfur dioxide $SO_2$, nitrogen dioxide $NO_2$ and phosphoric acid $H_3PO_4$ contained in the fresh air.

2. The air conditioning system of claim 1, further comprising a fresh air supply damper having a damper housing, said fresh air supply damper being located in a lower part of the clean room for recirculating the fresh air within the clean room, or for removing the fresh air from the clean room.

3. The air conditioning system of claim 2, further comprising one or more chemical ion-exchange filters disposed in the damper housing of the fresh air supply damper.

* * * * *